US011125201B2

(12) United States Patent
Terada et al.

(10) Patent No.: US 11,125,201 B2
(45) Date of Patent: Sep. 21, 2021

(54) IGNITION CONTROL SYSTEM FOR INTERNAL COMBUSTION ENGINE

(71) Applicant: DENSO CORPORATION, Kariya (JP)

(72) Inventors: Kanechiyo Terada, Kariya (JP); Tetsuya Miwa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/126,668

(22) Filed: Dec. 18, 2020

(65) Prior Publication Data

US 2021/0102521 A1 Apr. 8, 2021

Related U.S. Application Data

(63) Continuation of application No. PCT/JP2019/023179, filed on Jun. 12, 2019.

(30) Foreign Application Priority Data

Jun. 19, 2018 (JP) ..... JP2018-116070

(51) Int. Cl.
*F02P 3/04* (2006.01)
*F02P 17/12* (2006.01)
*H01F 38/12* (2006.01)

(52) U.S. Cl.
CPC ..... *F02P 3/04* (2013.01); *F02P 17/12* (2013.01); *H01F 38/12* (2013.01)

(58) Field of Classification Search
CPC .... F02P 3/04; F02P 11/00; F02P 11/02; F02P 11/06; F02P 17/00; F02P 17/12; F02P 2017/121; H01F 38/12
See application file for complete search history.

(56) References Cited

U.S. PATENT DOCUMENTS

| | | | | |
|---|---|---|---|---|
| 6,675,784 | B2 | 1/2004 | Nagase et al. | |
| 10,113,526 | B2 | 10/2018 | Takeda et al. | |
| 10,309,366 | B2 | 6/2019 | Seimiya et al. | |
| 2018/0195485 | A1 * | 7/2018 | Seimiya ..... | F02P 15/02 |

FOREIGN PATENT DOCUMENTS

| | | | |
|---|---|---|---|
| JP | H03-102708 | | 4/1991 |
| JP | 6-50249 | | 2/1994 |
| JP | 2001-280229 | | 10/2001 |
| JP | 2015-38337 | | 2/2015 |
| JP | 2015-200249 | | 11/2015 |
| JP | 2015-200284 | | 11/2015 |
| JP | 2015-201555 | | 11/2015 |
| JP | 2015200249 | A * | 11/2015 |
| JP | 2017-157367 | | 9/2017 |
| JP | 2017-210965 | | 11/2017 |

(Continued)

*Primary Examiner* — Jacob M Amick
(74) *Attorney, Agent, or Firm* — Nixon & Vanderhye P.C.

(57) ABSTRACT

An ignition control system for an internal combustion engine includes a controller, which includes an IGT generating section and an IGW generating section and is connected to ignition devices through an IGT signal line and an IGW signal line. The IGW signal line includes bifurcated portions, which sequentially bifurcate from a common main signal line. The bifurcated portions each correspond to one of the ignition devices and include a branched line, which is connected to an energy supply circuit inside the corresponding ignition device.

7 Claims, 8 Drawing Sheets

(56) References Cited

FOREIGN PATENT DOCUMENTS

| | | | | |
|---|---|---|---|---|
| JP | 2017210965 | A | * | 11/2017 |
| JP | 2018-037138 | | | 3/2018 |
| WO | 2016/157541 | | | 10/2016 |
| WO | 2017/073026 | | | 5/2017 |
| WO | 2017/183062 | | | 10/2017 |

* cited by examiner

IGNITION CONTROL SYSTEM FOR INTERNAL COMBUSTION ENGINE

CROSS-REFERENCE TO RELATED APPLICATION

This application is the U.S. bypass application of International Application No. PCT/JP2019/023179 filed on Jun. 12, 2019 which designated the U.S. and claims priority to Japanese Patent Application No. 2018-116070 filed on Jun. 19, 2018, the contents of both of which are incorporated herein by reference.

TECHNICAL FIELD

The present disclosure relates to an ignition control system for controlling ignition of an internal combustion engine.

BACKGROUND

Ignition control systems for spark ignition vehicle engines include ignition devices. Each ignition device includes an ignition coil, which includes a primary coil and a secondary coil. The ignition coil is connected to an ignition plug provided for each cylinder. A high voltage generated in the secondary coil by interruption of current supply to the primary coil is applied to the ignition plug, so that a spark discharge is caused. Additionally, ignition devices have been proposed that are capable of continuing the spark discharge with means for supplying discharge energy after start of the spark discharge in order to improve the ignitability to the air-fuel mixture by the spark discharge.

Multiple ignitions can be performed by a single ignition coil by repeating the ignition operation. However, to control the ignition in a more stable manner, an ignition device has been proposed that adds discharge energy during the spark discharge caused by the main ignition operation to increase the secondary current in a superimposed manner. For example, International Publication 2017/010310 proposes an ignition device that is provided with two systems of ignition energy supply means per each cylinder. The electrical discharge performed by the ignition energy supply means of one of the systems and the electrical discharge performed by the ignition energy supply means of the other system are superimposed on each other and output.

An ignition device disclosed in International Publication 2017/010310 includes, for example, two sets of ignition coils as the two systems of the ignition energy supply means. After the main ignition performed by one of the ignition coils, the secondary current is supplied in the same direction continuously using the other ignition coil. Thus, the spark discharge is continued in the same direction, which improves the ignitability. The signal indicating the point in time for supplying energy after the main ignition is transmitted through the signal line common to the cylinders. Thus, the energy is supplied regardless of the number of cylinders of the engine. Additionally, an abnormality in the other ignition coil is detected by monitoring the signal level of the common signal line.

SUMMARY

One aspect of the present disclosure provides an ignition control system for an internal combustion engine including ignition devices corresponding to cylinders of the internal combustion engine and a controller, which outputs signals for controlling the ignition devices. Each ignition device includes an ignition coil, which generates discharge energy in a secondary coil connected to an ignition plug by an increase and decrease in a primary current that flows through a primary coil, a main ignition circuit, which controls current supply to the primary coil to perform a main ignition operation that causes a spark discharge at the ignition plug, and an energy supply circuit, which performs an energy supply operation that superimposes current on a secondary current that flows through the secondary coil by the main ignition operation. The controller includes an IGT generating section, which generates a main ignition signal for controlling the main ignition operation, and an IGW generating section, which generates an energy supply signal for controlling the energy supply operation. The controller is connected to the ignition devices through an IGT signal line for transmitting the main ignition signal and an IGW signal line for transmitting the energy supply signal. The IGW signal line includes a common main signal line having one end connected to the controller and bifurcated portions, which sequentially bifurcate from the main signal line. The bifurcated portions each correspond to one of the ignition devices and include a branched line, which is connected to the energy supply circuit inside the corresponding ignition device. The bifurcated portions each include a main line, which forms a pair with the branched line, and the main lines are connected in series with each other and form a part of the main signal line. The controller includes an IGW monitor, which is connected to a signal path of the IGW signal line and monitors the energy supply signal. The IGW monitor receives a signal from the main line of the bifurcated portion that branches last from the main signal line, which serves as a distal end of the signal path of the IGW signal line, and the IGW monitor compares the signal input from the distal end with the energy supply signal output to one end of the main signal line from the IGW generating section to determine whether there is an abnormality.

BRIEF DESCRIPTION OF THE DRAWINGS

The above features of the present disclosure will be made clearer by the following detailed description, given referring to the appended drawings. In the accompanying drawings.

DETAILED DESCRIPTION OF THE PREFERRED EMBODIMENTS

Figure 1:
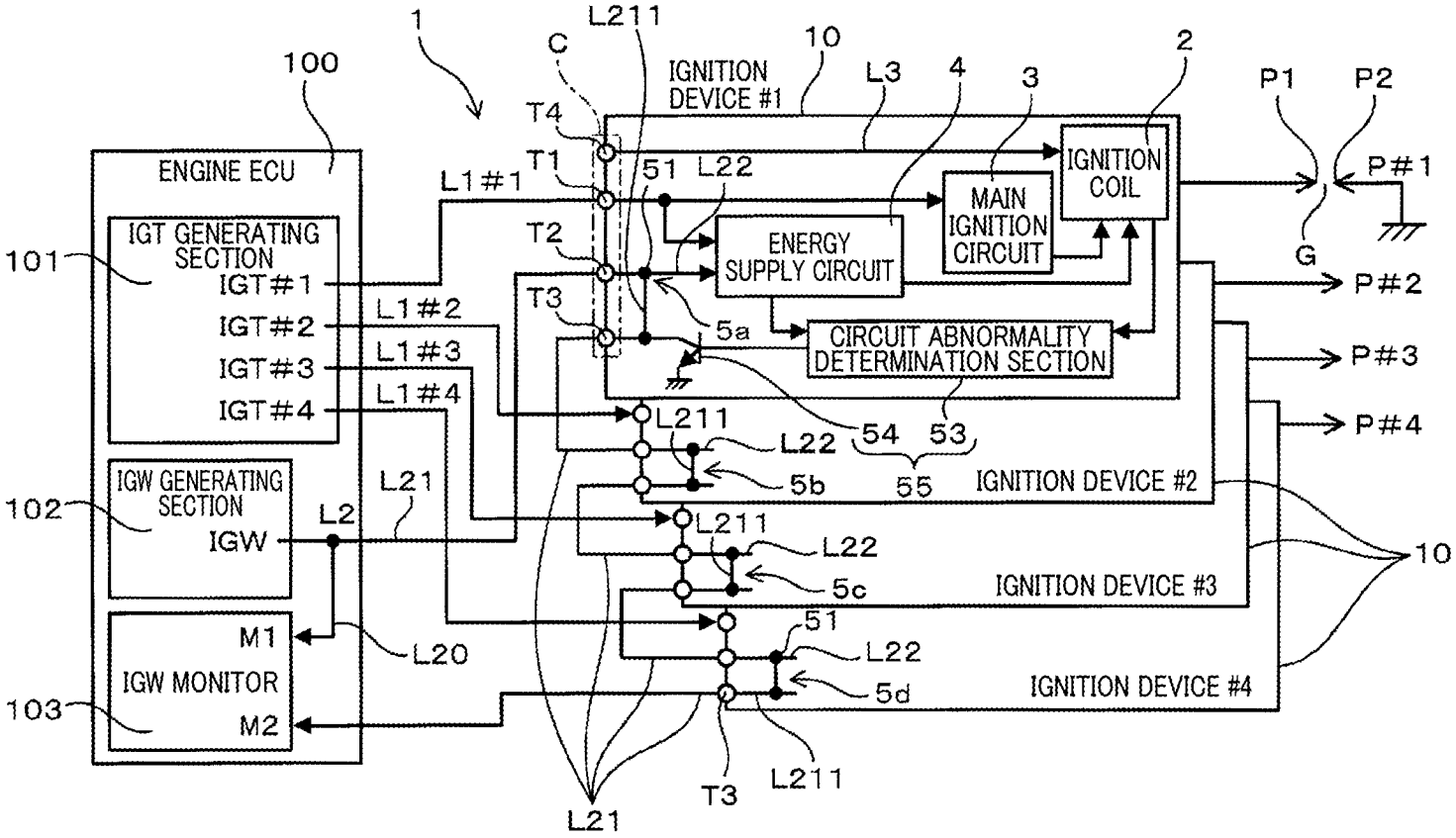
FIG. 1 is a schematic diagram illustrating the entire configuration of an ignition control system for an internal combustion engine according to a first embodiment.

In International Publication 2017/010310, the common signal line for supplying energy to the ignition devices includes one end connected to the engine controller and the other end branching in the middle by the number of cylinders. Each branched signal line is connected to the ignition device of the corresponding cylinder. With this configuration, control signals for supplying energy to multiple ignition devices can be output by adding one signal line to the engine controller. However, when actually mounting a wire harness in which one signal line has multiple branches, the following problem arises.

To make branches on the common signal line in the middle, specifically, it is necessary to connect different signal lines to the end of one signal line by, for example, soldering or using crimped terminals. Although it is generally preferred to make multiple branches at a single location to reduce the number of man-hours, if the number of cylinders is increased, the number of connecting lines at the branched portion of the signal line is increased, which is likely to decrease the reliability in the connection. Integrating multiple signal lines not only increases the size of the branched portion, but also increases the rigidity. This decreases the degree of freedom in mounting the wire harness in the vehicle.

It is an object of the present disclosure to provide a small, highly reliable ignition control system for an internal combustion engine. The structure for supplying energy to ignition devices using a common signal line has improved connection reliability at branched portions of the signal line and inhibits an increase in the size and a decrease in the flexibility of the branched portions, so that the degree of freedom in mounting the signal line is improved.

One aspect of the present disclosure provides an ignition control system for an internal combustion engine including ignition devices corresponding to cylinders of the internal combustion engine and a controller, which outputs signals for controlling the ignition devices. Each ignition device includes an ignition coil, which generates discharge energy in a secondary coil connected to an ignition plug by an increase and decrease in a primary current that flows through a primary coil, a main ignition circuit, which controls current supply to the primary coil to perform a main ignition operation that causes a spark discharge at the ignition plug, and an energy supply circuit, which performs an energy supply operation that superimposes current on a secondary current that flows through the secondary coil by the main ignition operation. The controller includes an IGT generating section, which generates a main ignition signal for controlling the main ignition operation, and an IGW generating section, which generates an energy supply signal for controlling the energy supply operation. The controller is connected to the ignition devices through an IGT signal line for transmitting the main ignition signal and an IGW signal line for transmitting the energy supply signal. The IGW signal line includes a common main signal line having one end connected to the controller and bifurcated portions, which sequentially bifurcate from the main signal line. The bifurcated portions each correspond to one of the ignition devices and include a branched line, which is connected to the energy supply circuit inside the corresponding ignition device. The bifurcated portions each include a main line, which forms a pair with the branched line, and the main lines are connected in series with each other and form a part of the main signal line. The controller includes an IGW monitor, which is connected to a signal path of the IGW signal line and monitors the energy supply signal. The IGW monitor receives a signal from the main line of the bifurcated portion that branches last from the main signal line, which serves as a distal end of the signal path of the IGW signal line, and the IGW monitor compares the signal input from the distal end with the energy supply signal output to one end of the main signal line from the IGW generating section to determine whether there is an abnormality.

In the ignition control system, the ignition devices perform the main ignition operation in accordance with the main ignition signal transmitted from the controller and further perform the energy supply operation in accordance with the energy supply signal. The IGW signal line for transmitting the energy supply signal has a compact structure in which the bifurcated portions sequentially branch from the common main signal line and has improved reliability in the connection of the bifurcated portions that branch from the main signal line.

Since the branches do not concentrate are not concentrated at one location of the common main signal line, an increase in the size of the branched portions and a decrease in the flexibility are inhibited, so that the degree of freedom in mounting the wire harness is improved. This inhibits the increase in the mounting space in the vehicle, and the limited space in the vehicle is efficiently used. Furthermore, an abnormality such as a disconnection is detected by, for example, monitoring signals at multiple locations in the common main signal line, which increases the reliability of the system.

As described above, the above aspect provides a small, highly reliable ignition control system for an internal combustion engine. The structure for supplying energy to ignition devices using a common signal line has improved connection reliability at branched portions of the signal line and inhibits an increase in the size and a decrease in the flexibility of the branched portions, so that the degree of freedom in mounting the signal line is improved.

First Embodiment

An ignition control system for an internal combustion engine according to a first embodiment will be described with reference to FIGS. 1 to 7.

In FIG. 1, an ignition control system 1 is applied to, for example, a spark ignition engine for vehicles and controls the ignition of an ignition plug P provided for each cylinder. The ignition control system 1 includes ignition devices 10 corresponding to cylinders of a non-illustrated engine and a controller, which outputs signals for controlling the ignition devices 10. The controller is an electronic control unit for an engine (hereinafter, simply referred to as an engine ECU 100).

The ignition devices 10 each include an ignition coil 2, a main ignition circuit 3, and an energy supply circuit 4. As shown by an exemplary configuration in FIG. 2, each ignition coil 2 generates discharge energy in a secondary coil 22, which is connected to the associated ignition plug P, in accordance with an increase or a decrease in a primary current I1 that flows through a primary coil 21. The main ignition circuit 3 controls current supply to the primary coil 21 to perform a main ignition operation that causes a spark discharge at the ignition plug P. The energy supply circuit 4 performs an energy supply operation that superimposes a current on a secondary current I2 that flows through the secondary coil 22 by the main ignition operation.

The engine ECU 100 includes an IGT generating section 101, which generates main ignition signals IGT for controlling the ignition operation, and an IGW generating section 102, which generates energy supply signals IGW for controlling the energy supply operation. The engine ECU 100 is connected to the ignition devices 10 through IGT signal lines L1 for transmitting the main ignition signals IGT and an IGW signal line L2 for transmitting the energy supply signals IGW. This configuration enables the main ignition signals IGT generated in the IGT generating section 101 and the energy supply signals IGW generated in the IGW generating section 102 to be transmitted to the ignition devices 10 at their respective predetermined point in time.

The IGW signal line L2 includes a common main signal line L21, one end of which is connected to the engine ECU 100, and bifurcated portions 5*a* to 5*d*, which are sequentially bifurcated from the main signal line L21. The bifurcated portions 5*a* to 5*d* each correspond to one of the ignition devices 10 and include a branched line L22, which is connected to the energy supply circuit 4 inside the corresponding ignition device 10.

More specifically, the bifurcated portions 5*a* to 5*d* each include a main line L211, which forms a pair with the associated branched line L22. The main lines L211 are connected in series with each other and constitute part of the main signal line L21. The branching position of each of the bifurcated portions 5*a* to 5*d* is desirably located inside the corresponding ignition device 10 or at the end connected to the corresponding ignition device 10.

Each ignition device 10 preferably includes a connector section C, which includes an IGT input terminal T1, an IGW input terminal T2, and an IGW output terminal T3. The IGT signal line L1 is connected to the IGT input terminal T1. The main signal line L21 is connected to the IGW input terminal T2 and the IGW output terminal T3. Each of the bifurcated portions 5*a* to 5*d* is located inside the associated ignition device 10 between the IGW input terminal T2 and the energy supply circuit 4. The main line L211 is connected to the IGW output terminal T3 to be drawn out of the ignition device 10.

Each ignition device 10 includes a signal level holding section 55, which holds the level of the signal of the main signal line L21 to an off state when an abnormality is detected in the energy supply circuit 4.

Furthermore, the engine ECU 100 includes an IGW monitor 103, which is connected to a signal path of the IGW signal line L2 and monitors the energy supply signals IGW.

The IGW monitor 103 receives, for example, a signal from the main line L211 of the bifurcated portion 5*d*, which branches last from the main signal line L21 and serves as the distal end of the signal path of the IGW signal line L2. The IGW monitor 103 determines the presence/absence of an abnormality by comparing the signal input from the distal end with the energy supply signal IGW output to one end of the main signal line L21 from the IGW generating section 102.

Hereinafter, the ignition devices 10 and the engine ECU 100, which constitute the ignition control system 1, will be described in detail.

The engine to which the ignition control system 1 of the present embodiment is applied is, for example, a four-cylinder engine (hereinafter, the cylinders will be referred to as cylinders #1 to #4) and includes the ignition plugs P (for example, indicated as P #1 to P #4 in FIG. 1) corresponding to the cylinders and the ignition devices 10 (for example, indicated as 10 #1 to 10 #4 in FIG. 1) corresponding to the ignition plugs P. In this embodiment, four ignition devices 10 are provided in accordance with the number of the cylinders. The main ignition signal IGT and the energy supply signal IGW are transmitted to each ignition device 10 from the engine ECU 100 to control current supply to the associated ignition coil 2.

The ignition plug P has a known structure and includes a center electrode P1 and a ground electrode P2, which face each other. The space formed between the distal ends of the electrodes is a spark gap G. The ignition device 10 activates the main ignition circuit 3 in response to the main ignition signal IGT and performs the main ignition operation on the ignition plug P. More specifically, when the discharge energy generated in the ignition coil 2 in response to the main ignition signal IGT is supplied, a spark discharge occurs in the spark gap G, allowing the air-fuel mixture in the non-illustrated engine combustion chamber to be ignited. After the main ignition, the energy supply circuit 4 of the ignition device 10 is activated in response to the energy supply signal IGW to perform an operation to supply energy to the ignition coil 2, so that the spark discharge is continued.

The engine ECU 100 generates the main ignition signal IGT for each cylinder (for example, indicated as IGT #1 to IGT #4 in FIG. 1) in the IGT generating section 101 and transmits it to the ignition device 10 of the corresponding cylinder through the IGT signal line L1 for each cylinder (for example, indicated as L1 #1 to L1 #4 in FIG. 1). Additionally, the engine ECU 100 generates the energy supply signal IGW corresponding to each cylinder (for example, indicated as IGW #1 to IGW #4 in FIG. 5) in the IGW generating section 102 and transmits it to the cylinder through the IGW signal line L2, which includes the common main signal line L21.

The engine ECU 100 includes the IGW monitor 103 and monitors the transmitted energy supply signal IGW at, for example, multiple locations to detect an output abnormality of the energy supply signal IGW, a disconnection of the IGW signal line L2, or an abnormality in the operation or the circuit of the energy supply circuit 4 of each ignition device 10. In the present embodiment, the IGW monitor 103 includes a first monitor terminal M1 and a second monitor terminal M2.

The connector section C of each ignition device 10 includes the IGT input terminal T1, to which the IGT signal line L1 is connected, and the IGW input terminal T2 and the IGW output terminal T3, to which the IGW signal line L2 is connected. Four IGT signal lines L1 (L1 #1 to L1 #4) of the cylinders each include one end connected to the IGT generating section 101 and the other end connected to the main ignition circuit 3 and the energy supply circuit 4 inside the ignition device 10 of each cylinder.

The connector section C also includes a supply terminal T4, which is connected to a non-illustrated power supply, and current can be supplied to the ignition coil 2 through a supply line L3. Besides these terminals, the connector section C includes a non-illustrated ground terminal T5.

One end of the main signal line L21 of the IGW signal line L2 is connected to the IGW generating section 102, and the other end sequentially passes through the inside of the four ignition devices 10 via the IGW input terminals T2 and the IGW output terminals T3 of the ignition devices 10. The branched lines L22 bifurcate from the main signal line L21 one after the other inside the ignition devices 10 to form the bifurcated portions 5*a* to 5*d*.

The common main signal line L21 located between the IGW generating section 102 and the four ignition devices 10 is first connected to the IGW input terminal T2 of one of the four ignition devices 10 (for example, the ignition device #1 corresponding to the cylinder #1) and bifurcates inside the ignition device 10 (#1 cylinder). One line connected to the branch point 51 at the bifurcated portion 5*a* is the branched line L22 and is connected to the energy supply circuit 4. The other line connected to the branch point 51 is the main line L211, which constitutes a pair with the branched line L22, and forms part of the main signal line L21. The main line L211 is connected to the IGW output terminal T3 and is drawn out to the outside.

On the outside of the ignition device 10 (#1), the main signal line L21 drawn out from the IGW output terminal T3 is connected to the IGW input terminal T2 of another ignition device 10 (for example, the ignition device 10 #2 corresponding to the cylinder #2). Similarly, the bifurcated portion 5*b* is also formed inside the ignition device 10 (#2). One branch of the bifurcated portion 5*b* is connected to the energy supply circuit 4 as the branched line L22, and the other branch of the bifurcated portion 5*b* is connected to the IGW output terminal T3 as the main line L211 to be drawn out to the outside. Furthermore, the bifurcated portions 5*c* and 5*d*, which have the same configuration, are provided in the other ignition devices 10 (#3, #4).

In this manner, while passing through the inside of the four ignition devices 10 in the order of cylinder #1 to cylinder #4, the IGW signal line L2 branches the bifurcated portions 5*a* to 5*d* one after the other inside the ignition devices 10 along the way. The main lines L211 of the bifurcated portions 5*a* to 5*d* are series connected with each other through the main signal line L21 located outside the ignition devices 10, the IGW input terminals T2, and the IGW output terminals T3 and form a signal path, which forms one continuous main signal line L21.

In each of the bifurcated portions 5*a* to 5*d*, the branched line L22 branched from the main signal line L21 is connected to the associated energy supply circuit 4. Thus, the energy supply signal IGW that is the same as the one transmitted to the main signal line L21 is input to the energy supply circuit 4 of each ignition device 10. The energy supply circuit 4 can distinguish the energy supply signal IGW of each cylinder by, for example, a logical product with the main ignition signal IGT input through the IGT signal line L1. This allows the energy supply circuit 4 to perform the energy supply operation in response to the energy supply signal IGW.

The bifurcated portion 5*d*, which is bifurcated last from the main signal line L21 of the IGW signal line L2, is formed inside the ignition device 10 of the cylinder #4. The main line L211 of the bifurcated portion 5*d* is connected to the IGW output terminal T3 to be drawn out to the outside and is connected to the second monitor terminal M2 of the IGW monitor 103 through the main signal line L21 that serves as the distal end of the IGW signal line L2. In the engine ECU 100, a signal line L20, which branches from one end of the IGW signal line L2, is connected to the first monitor terminal M1 of the IGW monitor 103. Thus, the IGW monitor 103 is capable of comparing the energy supply signal IGW that is immediately after being output from the IGW generating section 102 with the signal that has passed through the four ignition devices 10 at the distal end of the main signal line L21.

Figure 5:
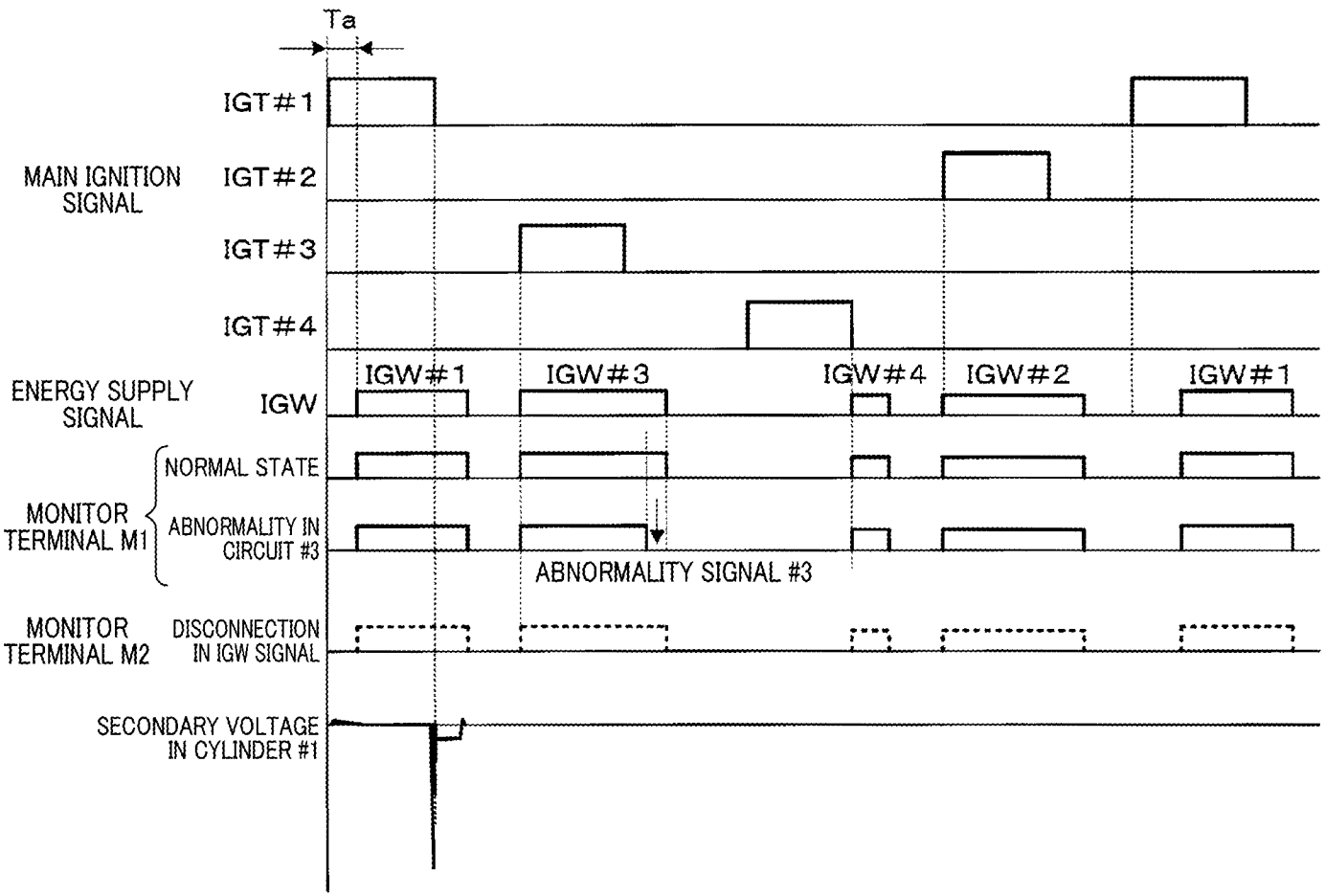
FIG. 5 is a timing chart showing the relationship between various signals generated by a controller of the ignition control system, the ignition operation of the ignition devices, and signals input to an IGW monitor of the controller according to the first embodiment.

If there is an abnormality such as a disconnection in the wiring connecting the engine ECU 100 to the ignition device 10 of the cylinder #4, or between the ignition devices 10 of the cylinders #1 to #4, or in the internal circuits of the ignition devices 10, the signal input to the second monitor terminal M2 does not match the energy supply signal IGW that has been output (for example, refer to IGW disconnection state in FIG. 5). Thus, while monitoring the energy supply signal IGW on one end of the main signal line L21 by the first monitor terminal M1, the IGW monitor 103 monitors the signal from the main signal line L21 connected to the bifurcated portion 5*d*, which is the distal end of the signal path of the IGW signal line L2, by the second monitor terminal M2. Comparing the instruction from the engine ECU 100 with these signals enables detecting an abnormality such as a disconnection.

Each ignition device 10 includes a circuit abnormality determination section 53 and a switching element 54, which constitute the signal level holding section 55. For example, when an abnormality of some kind is detected in the operation of the energy supply circuit 4 by the circuit abnormality determination section 53, the signal level holding section 55 drives the switching element 54 to hold the level of the signal of the main signal line L21 to the off state (for example, L level).

The switching element 54 is a bipolar transistor such as an NPN transistor. Current is conducted or interrupted between the collector terminal and the emitter terminal by controlling the base current in accordance with a drive voltage input to the base terminal.

More specifically, at a position between the branch point 51 and the IGW output terminal T3 of each of the bifurcated portions 5*a* to 5*d*, the switching element 54 is connected between the main line L211 and the ground terminal and is switched on and off by the circuit abnormality determination section 53. In a normal state, the switching element 54 is switched off, so that the path between the main line L211 and the ground terminal is interrupted. The circuit abnormality determination section 53 monitors, for example, the secondary current I2 subjected to the energy supply operation performed by the energy supply circuit 4 and the primary current I1 of the ignition coil 2 when the energy supply signal IGW is input to determine the presence/absence of an abnormality. If an abnormality is detected, the circuit abnormality determination section 53 switches on the switching element 54. When the signal level holding section 55 is operated upon detection of an abnormality, the main line L211 is connected to the ground potential, so that the signal is held to the L level regardless of the instruction from the engine ECU 100 (for example, refer to IGW #3 in FIG. 5). The holding of the signal to the L level is achieved by the combination of a logic circuit of the energy supply signal IGW and the main ignition signal IGT and a timer circuit so as to be restored before the energy supply signal IGW of the next cylinder is output.

In this case also, the IGW monitor 103 monitors the signal input to the second monitor terminal M2 and compares the instruction from the engine ECU 100 with the signal input to the second monitor terminal M2. This enables determining the abnormality detection result of the energy supply circuit 4.

The operation of the IGW monitor 103 will be described in detail below.

Figure 2:
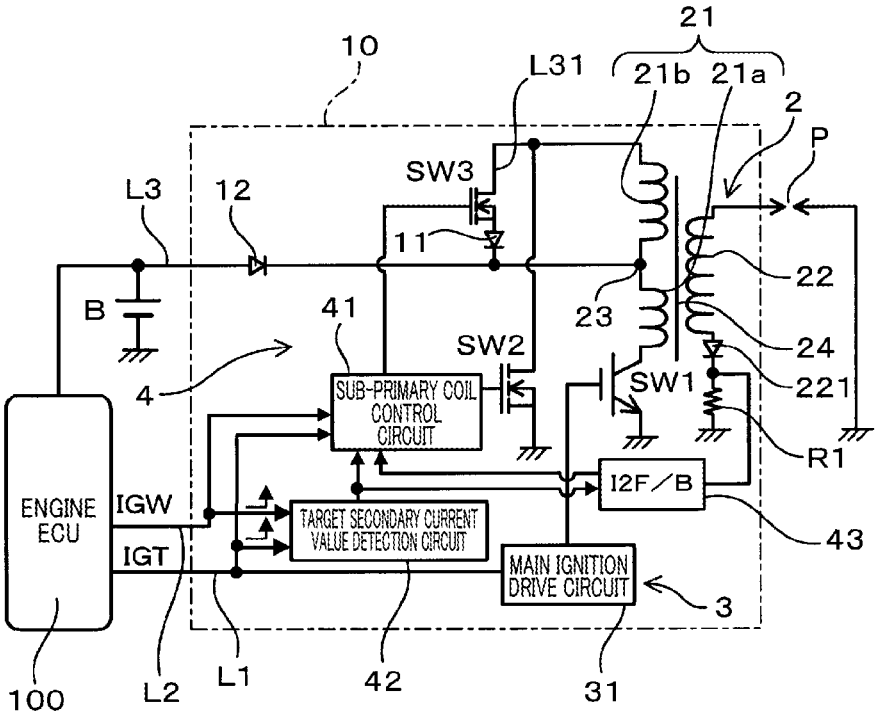
FIG. 2 is a circuit diagram illustrating an exemplary ignition device used in the ignition control system for the internal combustion engine according to the first embodiment.

FIG. 2 shows an exemplary specific configuration of the ignition device 10. The primary coil 21 of the ignition coil 2 may include, for example, a main primary coil 21*a* and a sub-primary coil 21*b*. In this case, the main ignition circuit 3 controls current supply to the main primary coil 21*a* to control the main ignition operation, and the energy supply circuit 4 controls current supply to the sub-primary coil 21*b* to control the energy supply operation.

The main primary coil 21*a* or the sub-primary coil 21*b*, which serves as the primary coil 21, and the secondary coil 22 are magnetically coupled, so that the ignition coil 2 forms a known boost transformer. One end of the secondary coil 22 is connected to the center electrode P1 of the ignition plug P, and the other end is grounded through a first diode 221 and a secondary current detection resistance RE The first diode 221 is located so that an anode terminal is connected to the secondary coil 22 and a cathode terminal is connected to the secondary current detection resistance R1 to restrict the direction of the secondary current I2 that flows through the secondary coil 22.

The main primary coil 21*a* and the sub-primary coil 21*b* are series connected with each other and are connected in parallel to a DC power supply B such as a vehicle battery. More specifically, an intermediate tap 23 is located between a first end of the main primary coil 21*a* and a first end of the sub-primary coil 21*b*. The intermediate tap 23 is connected to the supply line L3, which extends to the DC power supply B. A second end of the main primary coil 21*a* is grounded through a switching element for main ignition (hereinafter, referred to as a main ignition switch) SW1, and a second end of the sub-primary coil 21*b* is grounded through a switching element for continuing discharge (hereinafter, referred to as a discharge continuing switch) SW2.

This allows the DC power supply B to be electrically connected to the main primary coil 21*a* or the sub-primary coil 21*b* when the main ignition switch SW1 or the discharge continuing switch SW2 is on.

Sufficiently increasing the turns ratio causes a predetermined high voltage corresponding to the turns ratio to be generated in the secondary coil 22. The turns ratio is the ratio between the number of turns of the main primary coil 21*a* or the sub-primary coil 21*b*, which is the primary coil 21, and the number of turns of the secondary coil 22. The main primary coil 21*a* and the sub-primary coil 21*b* are wound so that the directions of the magnetic flux generated when current is supplied from the DC power supply B are opposite to each other, and the number of turns of the sub-primary coil 21*b* is set to be less than the number of turns of the main primary coil 21*a*. With this configuration, after a discharge occurs at the spark gap G of the ignition plug P by a voltage caused by the interruption of current supply to the main primary coil 21*a*, a superimposed magnetic flux is generated in the same direction by current supply to the sub-primary coil 21*b*, so that discharge energy is increased in a superimposed manner.

Figure 3:
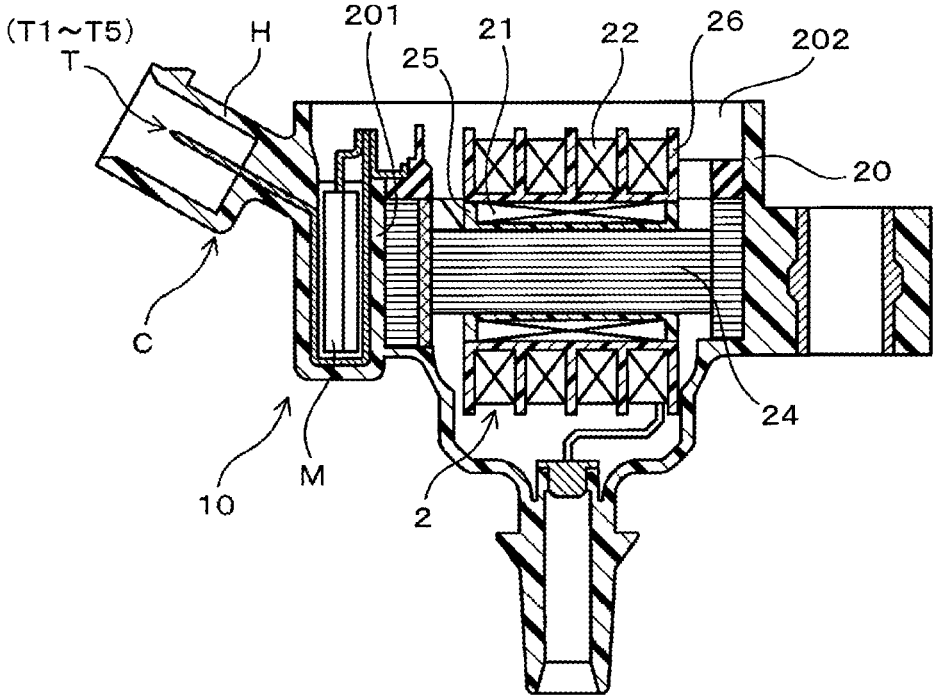
FIG. 3 is a vertical cross-sectional view of the ignition device constituting the ignition control system according to the first embodiment.

As shown in FIG. 3, the ignition coil 2 is integrally formed by winding the primary coil 21 and the secondary coil 22 around, for example, a tubular primary coil bobbin 25 and a tubular secondary coil bobbin 26 located around a shaft-like core 24. The ignition coil 2 is accommodated in a housing 20 together with a circuit module M, which constitutes the circuit of the ignition device 10, and is sealed with an insulating resin 202 that fills the housing 20. In the housing 20, the ignition coil 2 and the circuit module M are separated by a partition 201, and the connector section C is integrally provided on the outer wall of the housing 20 adjacent to the circuit module M. The connector section C includes a tubular housing H and connector terminals T, which are accommodated inside the housing H.

Figure 4:
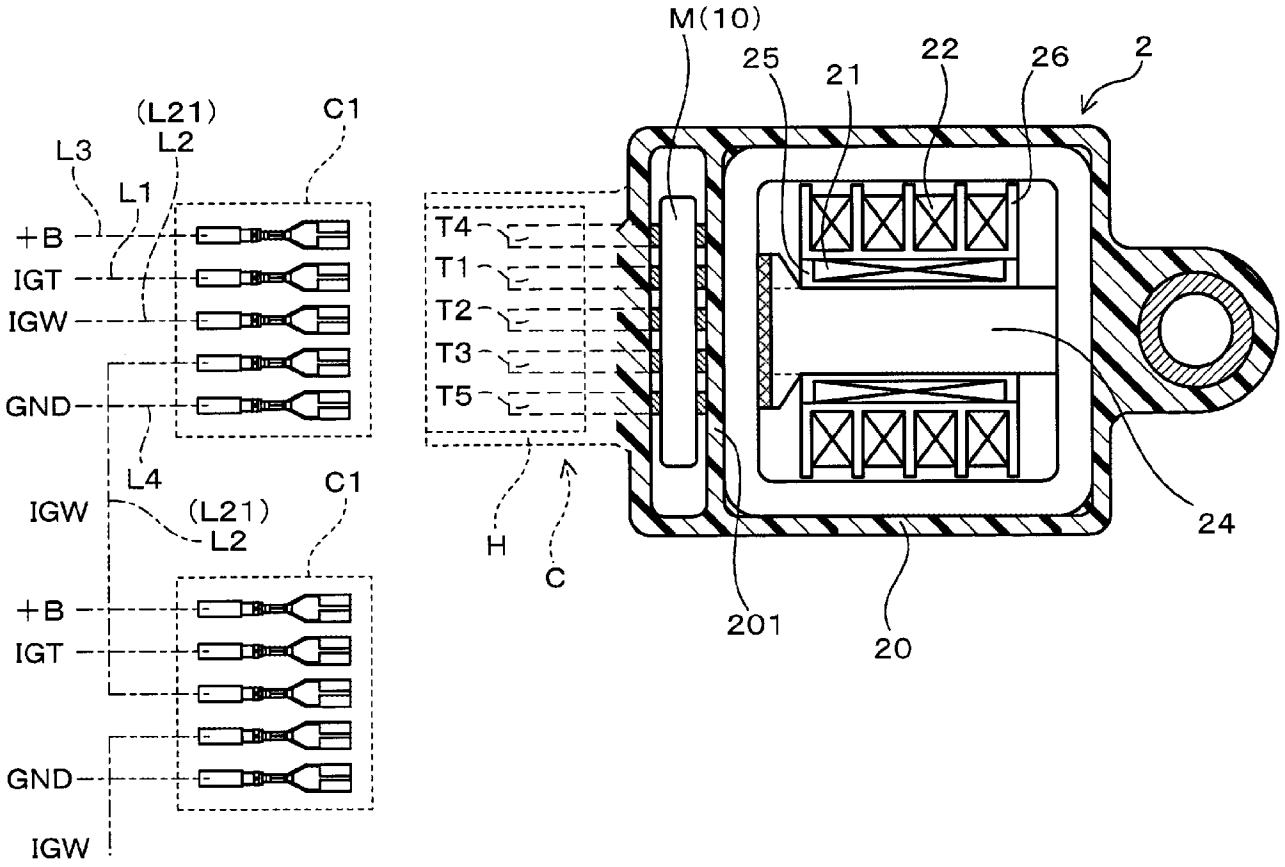
FIG. 4 is a diagram illustrating the connection structure of signal lines in a transverse cross-sectional view of the ignition device constituting the ignition control system according to the first embodiment.

As shown in FIG. 4, five terminals are provided in the housing H of the connector section C as the connector terminals T. The IGT input terminal T1, the IGW input terminal T2, and the IGW output terminal T3 are located in this order between the supply terminal T4 and the ground terminal T5 located on the ends. A connecting terminal portion C1, which extends from the engine ECU 100, is inserted in and fitted to the housing H of the connector section C and is connected to the connector terminals T. The connecting terminal portion C1 includes the IGT signal line L1 and the IGW signal line L2 of the engine ECU 100, which are connected to the IGT input terminal T1 and the IGW input terminal T2. The IGW signal line L2 one end of which is connected to the IGW output terminal T3 has the other end constituting the connecting terminal portion C1 corresponding to another ignition device 10. The supply terminal T4 and the ground terminal T5 of the connector section C are connected to the supply line L3 and a ground line L4.

In FIG. 2, the main ignition circuit 3 includes the main ignition switch SW1 and a switch drive circuit for main ignition operation (hereinafter, referred to as a main ignition drive circuit) 31, which switches on and off the main ignition switch SW1. The main ignition switch SW1 is a voltage-driven switching element such as an IGBT (that is, an insulated gate bipolar transistor). The collector terminal and the emitter terminal are electrically connected or interrupted by controlling the gate potential in accordance with a drive signal input to the gate terminal. The collector terminal of the main ignition switch SW1 is connected to the second end of the main primary coil 21*a*, and the emitter terminal is grounded.

The main ignition drive circuit 31 generates a drive signal corresponding to the main ignition signal IGT and switches the main ignition switch SW1 on and off. More specifically (for example, refer to IGT #1 shown in FIG. 5), when the main ignition switch SW1 is switched on at the rising of the main ignition signal IGT, current supply to the main primary coil 21*a* is started, so that the primary current I1 flows. Subsequently, when the main ignition switch SW1 is switched off at the falling of the main ignition signal IGT, the current supply to the main primary coil 21*a* is interrupted, so that a high secondary voltage V2 is generated in the secondary coil 22 due to mutual induction. The secondary voltage V2 is applied to the spark gap G of the ignition plug P, so that a spark discharge occurs, and the secondary current I2 flows.

The energy supply circuit 4 includes the discharge continuing switch SW2, a sub-primary coil control circuit 41, a target secondary current value detection circuit 42, and a secondary current feedback circuit (for example, indicated as I2F/B in FIG. 2) 43. The sub-primary coil control circuit 41 controls current supply to the sub-primary coil 21*b* by outputting drive signals for switching on and off the discharge continuing switch SW2. The target secondary current value detection circuit 42 detects a set value of a target secondary current value I2tgt during the energy supply operation. The secondary current feedback circuit 43 generates a signal for feedback controlling the secondary current I2.

Furthermore, a switching element (hereinafter, referred to as a recirculation switch) SW3 for opening and closing a recirculation path L31, which is connected to the sub-primary coil 21*b*, is provided and is switched in response to a drive signal from the sub-primary coil control circuit 41.

The discharge continuing switch SW2 and the recirculation switch SW3 are, for example, MOSFETs (that is, field-effect transistors). The drain terminal of the discharge continuing switch SW2 is connected to the second end of the sub-primary coil 21*b*, and the source terminal is grounded.

The target secondary current value detection circuit 42 detects the set value of the target secondary current value I2tgt instructed from the engine ECU 100 and transmits it to the secondary current feedback circuit 43. The target secondary current value I2tgt is previously set in accordance with, for example, the engine operating condition in the engine ECU 100 and is indicated as, for example, pulse waveform information of the main ignition signal IGT and the energy supply signal IGW (for example, the rising phase difference).

The secondary current feedback circuit 43 compares the set value of the target secondary current value I2tgt with the detected value of the secondary current I2 based on the secondary current detection resistance R1 and outputs a feedback signal based on the comparison result to the sub-primary coil control circuit 41.

The recirculation path L31 is located between the second end of the sub-primary coil 21*b* (that is, the end further from the main primary coil 21*a*) and the supply line L3. The drain terminal of the recirculation switch SW3 is connected to the contact point between the second end of the sub-primary coil 21*b* and the discharge continuing switch SW2, and the source terminal is connected to the supply line L3 through a second diode 11. The supply line L3 is provided with a third diode 12 located between the contact point with the recirculation path L31 and the DC power supply B. The forward direction of the second diode 11 is the direction toward the supply line L3, and the forward direction of the third diode 12 is the direction toward the primary coil 21. Thus, when the discharge continuing switch SW2 is off, the recirculation switch SW3 is switched on, so that the second end of the sub-primary coil 21*b* and the supply line L3 are connected through the recirculation path L31. Since the recirculation current flows during the interruption of current to the sub-primary coil 21*b*, the current through the sub-primary coil 21*b* changes gradually. This inhibits a rapid decrease in the secondary current I2.

Next, the ignition control performed by the engine ECU 100 and the operation of the IGW monitor 103 will be described with reference to FIG. 5. As described above, the IGT generating section 101 of the engine ECU 100 outputs the main ignition signal IGT corresponding to each cylinder in the order of, for example, IGT #1, IGT #3, IGT #4, and IGT #2 to the corresponding IGT signal line L1. Upon receipt of the main ignition signal IGT, the main ignition circuit 3 is activated in the ignition device 10 of each cylinder to start the main ignition operation of the ignition coil 2. That is, as shown with the cylinder #1 in FIG. 5, at the rising of the main ignition signal IGT, current supply to the main primary coil 21*a* is started, and at the falling of the main ignition signal IGT, the current supply is interrupted, so that a high secondary voltage V2 is generated in the secondary coil 22, and thus starting the main ignition operation.

If the operating range of the engine is in an energy supply region, the IGW generating section 102 generates, after the main ignition operation is started, the energy supply signal IGW for superimposing a discharge current and outputs it to the IGW signal line L2. Like the main ignition signals IGT, the energy supply signals IGW are generated in the order of, for example, IGW #1, IGW #3, IGW #4, and IGW #2, and the same energy supply signals IGW are input to the ignition devices 10 of the cylinders through the common main signal line L21.

While the sub-primary coil control circuit 41 is receiving, for example, the main ignition signal IGT of the corresponding cylinder (that is, during the H level), the energy supply circuit 4 extracts a signal input from the main signal line L21 as the energy supply signal IGW of that cylinder and performs the energy supply operation at a predetermined point in time. At this time, for example, the target secondary current value detection circuit 42 detects the target secondary current value I2tgt, which is indicated by the rise time difference Ta between the main ignition signal IGT and the energy supply signal IGW, and outputs it to the secondary current feedback circuit 43. The secondary current feedback circuit 43 outputs, to the sub-primary coil control circuit 41, the result obtained by comparing the detected value of the secondary current I2 based on the secondary current detection resistance R1 with the threshold value based on the set value of the target secondary current value I2tgt.

With this configuration, the sub-primary coil control circuit 41 causes current to be supplied to the sub-primary coil 21*b* to seek the set value of the target secondary current value I2tgt, thus performing the energy supply operation. In an energy supply time period during which the energy supply operation is performed, the secondary voltage V2 of the secondary coil 22 is kept at a discharge maintaining voltage lower than that during the main ignition operation. The energy supply time period is instructed by, for example, the falling signal of the main ignition signal IGT and the energy supply signal IGW, and when the energy supply time period ends by the falling of the energy supply signal IGW, current supply to the sub-primary coil 21*b* is stopped, so that the secondary voltage V2 of the secondary coil 22 is decreased.

The IGW monitor 103 includes the first monitor terminal M1, which monitors the energy supply signal IGW output from the IGW generating section 102 as it is, and the second monitor terminal M2, which monitors the signal that has passed through the ignition devices 10, and determines the presence/absence of an abnormality by comparing the monitored values. More specifically, as shown in Table 1 below, an abnormality in the signal path of the energy supply signal IGW can be determined by comparing the instruction from the engine ECU 100 with the input value of the first monitor terminal M1 (first monitor value) and further comparing the first monitor value with the input value of the second monitor terminal M2 (second monitor value).

TABLE 1

| Signal output instruction | First monitor value | Second monitor value | Determination result | IGW circuit abnormality | IGW signal disconnection |
|---|---|---|---|---|---|
| Issued | Same as instruction signal | Same as instruction signal | Cylinder #N is normal/ No disconnection | No abnormality | No disconnection |

TABLE 1-continued

| Signal output instruction | First monitor value | Second monitor value | Determination result | IGW circuit abnormality | IGW signal disconnection |
|---|---|---|---|---|---|
| Issued | Same as instruction signal | Held to OFF (L) | Cylinder #N is normal/ Disconnection after cylinder #N | No abnormality | Disconnection has occurred (other cylinders) |
| Issued | Differs from instruction signal | Same as first monitor value | Abnormality in cylinder #N/ No disconnection | Abnormality exists | No disconnection |
| Issued | Differs from instruction signal | Held to OFF (L) | Abnormality in cylinder #N/ Disconnection after cylinder #N | Abnormality exists | Disconnection has occurred (other cylinders) |

An IGW path abnormality determination process for the ignition device 10 of each cylinder performed by the IGW monitor 103 will be described with reference to Table 1 in accordance with the flowchart shown in FIG. 6.

In this routine, the IGW path abnormality determination process is performed sequentially for all the cylinders with the numerals of the cylinders set to #N (#1 to #4). In this case, as shown in Table 1, a disconnection in the main signal line L21 of the energy supply signal IGW (IGW signal disconnection) and an abnormality in the energy supply circuit 4 monitored by the circuit abnormality determination section 53 (IGW circuit abnormality) can be separately detected for each cylinder.

The routine may be performed by transmitting a signal for checking, for example, before and after starting the engine or when the engine is stopped besides during the operation that involves the energy supply operation. In this case, the IGW path abnormality determination process does not necessarily have to be performed for all the cylinders.

Figure 6:
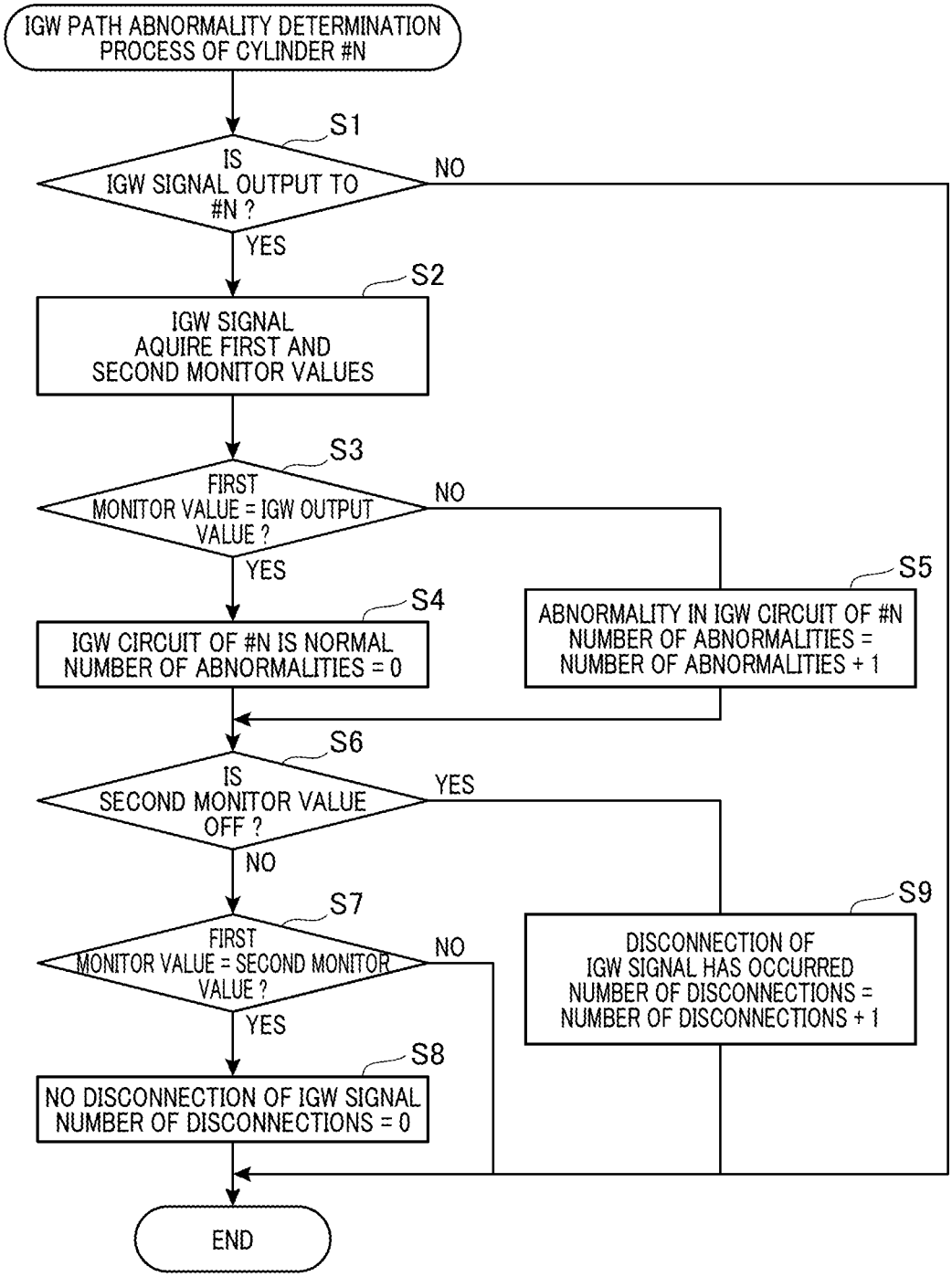
FIG. 6 is a flowchart of an abnormality determination process performed by the controller constituting the ignition control system according to the first embodiment.

When the IGW path abnormality determination process is started in FIG. 6, first, at step S1, it is determined whether the energy supply signal IGW is output to the cylinder #N from the IGW generating section 102 in response to the energy supply instruction from the engine ECU 100 (that is, is IGW signal output?). If the operating condition of the engine is in the previously set energy supply operation region, the engine ECU 100 outputs, subsequent to the main ignition signal IGT, the energy supply signal IGW at a predetermined point in time, so that the signal voltage level is switched from the L level to the H level (for example, from 0V to 12V).

If the decision outcome of step S1 is negative, this iteration of the routine is terminated.

If the decision outcome of step S1 is positive (that is, if the signal output instruction in Table 1 is "Issued"), the process proceeds to step S2, and the first monitor value is acquired from the first monitor terminal M1, and the second monitor value is acquired from the second monitor terminal M2. Subsequently, the process proceeds to step S3, and it is determined whether the first monitor value is equal to the output value of the energy supply signal IGW (that is, first monitor value=IGW output value?). If the decision outcome of step S3 is positive, the process proceeds to step S4, and if the decision outcome of step S3 is negative, the process proceeds to step S5.

At step S4, it is determined that the first monitor value is equal to the output value of the energy supply signal IGW (that is, the first monitor value in Table 1 is "Same as instruction signal"), and thus the energy supply circuit 4 of the cylinder #N is normal (that is, the circuit abnormality in Table 1 is "No abnormality"). In this case, the count of the number of abnormalities is cleared (that is, number of abnormalities=0), and then the process proceeds to step S6.

At step S5, it is determined that the first monitor value differs from the output value of the energy supply signal IGW (that is, the first monitor value in Table 1 is "Differs from instruction signal") and thus there is an abnormality in the energy supply circuit 4 of the cylinder #N (that is, the circuit abnormality in Table 1 is "Abnormality exists"). In this case, the count of the number of abnormalities is incremented (number of abnormalities=number of abnormalities+1), and the process proceeds to step S6.

In FIG. 1, when the cylinder #N is being checked for example, if the signal level holding section 55 of the corresponding ignition device 10 is operated, the main line L211 is held to the L level. Thus, the main signal line L21, which is connected to the main line L211, also has the same potential. Consequently, the first monitor value detected on one end of the main signal line L21 differs from the instruction from the engine ECU 100. Monitoring the difference allows an abnormality to be detected.

At step S6, it is determined whether the signal level of the second monitor value is in the off state (that is, is the second monitor value OFF?). If the decision outcome of step S6 is negative, the process proceeds to step S7, and it is further determined whether the second monitor value is equal to the first monitor value (that is, first monitor value=second monitor value?).

If the decision outcome of step S7 is positive, at step S8, it is determined that there is no disconnection of the signal path of the energy supply signal IGW (that is, the disconnection in Table 1 is "No disconnection"). In this case, the count for the number of disconnections is cleared (that is, number of disconnections=0), and then this iteration of the routine is terminated.

If the decision outcome of step S7 is negative, this iteration of the routine is terminated as it is.

In FIG. 1, if a disconnection occurs in a given position in the main signal line L21, the energy supply signal IGW is not transmitted to the cylinders after the disconnection location. In other words, if the second monitor value, which is at the distal end of the main signal line L21, is held to the L level, it means there is a disconnection. Thus, the disconnection can be detected by monitoring the second monitor value.

In FIG. 1, if there is no disconnection anywhere in the main signal line L21, the signal level on both ends of the main signal line L21 will be the same potential regardless of the presence/absence of the circuit abnormality in the energy supply circuit 4 of the ignition devices 10 (that is, the second monitor value in Table 1 is "Same as instruction signal" or "Same as first monitor value").

If the decision outcome of step S6 is positive (that is, the second monitor value in Table 1 is "Hold to OFF (L)"), at step S9, it is determined that there is a disconnection in the signal path of the energy supply signal IGW (that is, the disconnection in Table 1 is "Disconnection has occurred"). In this case, the count for the number of disconnections is incremented (that is, number of disconnections=number of disconnections+1). Subsequently, this iteration of the routine is terminated.

In this manner, events such as a circuit abnormality and a disconnection in the signal path of the energy supply signal IGW are detected using the first monitor value and the second monitor value.

As shown in Table 1, the state in which it is determined that a circuit abnormality exists at step S5 further includes a case in which a disconnection has occurred and a case in which a disconnection does not exist. If the first monitor value and the second monitor value are the same, it is determined that there is a circuit abnormality in the cylinder #N, and if the second monitor value differs from the first monitor value and is held to OFF, it is determined that a disconnection has occurred.

The first monitor value and the second monitor value may be acquired by sensing the signal level at certain intervals while the energy supply signal IGW is output and may be compared with the IGW output instruction value, or may be compared with an IGW output signal using a comparison circuit such as an exclusive OR circuit. The comparison may be performed during the entire time period in which the energy supply signal IGW is output, or only during the time period from the falling of the main ignition signal IGT to the falling of the energy supply signal IGW, or just at a predetermined point in time including the point in time in which the circuit abnormality is detected during the IGW output time period.

The operations of the abnormality counter and the disconnection counter are not limited to the above-described method of the present embodiment. For example, in the above-described method, instead of clearing the abnormality or disconnection counter (that is, number of abnormalities or number of disconnections=0), the abnormality or disconnection counter may be decremented (that is, number of abnormalities or number of disconnections=number of abnormalities or number of disconnections−1), and the weights of the abnormality determination and the normal determination may be changed. Furthermore, the determination may be made without using the counters.

In this case, the disconnection location is temporarily determined using the relationship shown in Table 1 by performing the routine on all the cylinders. For example, if the order of ignition of the four cylinders is #1→#3→#4→#2, and the order of wiring of the energy supply signal IGW is #1→#2→#3→#4→ECU, the disconnection location is determined as follows.

If it is determined that the circuit is normal in the cylinder #1 and that there is a disconnection, the disconnection has occurred anywhere from the cylinder #1 to #4 and ECU.

If it is determined that the circuit is normal in the cylinder #3 and that there is a disconnection, the disconnection has occurred anywhere from the cylinder #3 to #4 and ECU.

If it is determined that the circuit is normal in the cylinder #4 and that there is a disconnection, the disconnection has occurred anywhere from the cylinder #4 to ECU.

If it is determined that the circuit is normal in the cylinder #2 and that there is a disconnection, the disconnection has occurred anywhere in the cylinder #2 to #4 and ECU.

Similarly, if there is a circuit abnormality in each cylinder, the disconnection location is more accurately determined using the relationship shown in Table 1.

In this case, in FIG. 1, if there is no disconnection in the main signal line L21, the signal on one end of the main signal line L21 and the signal on the other end are always the same (that is, the second monitor value in Table 1 is "Same as first monitor value"). Thus, the signal level when there is an abnormality is set to the L level not for the entire time period of the IGW signal. This allows the circuit abnormality to be distinguished from the case when there is a disconnection. Consequently, an abnormality in the signal path is determined in more detail.

For example, in the case in which the ignition order of the four cylinders is #1→#3→#4→#2, and the order of wiring of the energy supply signal IGW is #1→#2→#3→#4→ECU, the disconnection location is determined as follows.

If it is determined that there is a circuit abnormality in the cylinder #1 and that there is a disconnection, the disconnection has occurred anywhere from the cylinder #1 to #4 and the ECU.

If it is determined that there is a circuit abnormality in the cylinder #3 and that there is a disconnection, the disconnection has occurred anywhere from the cylinder #3 to #4 and ECU.

If it is determined that there is a circuit abnormality in the cylinder #4 and that there is a disconnection, the disconnection has occurred anywhere from the cylinder #4 to ECU.

If it is determined that there is a circuit abnormality in the cylinder #2 and that there is a disconnection, the disconnection has occurred anywhere from the cylinder #2 to #4 and ECU.

The IGW path abnormality determination process for the ignition device 10 of each cylinder performed by the IGW monitor 103 will be described with reference to Table 1 in accordance with the flowchart of FIG. 6.

In this routine, the IGW path abnormality determination process is performed sequentially for all the cylinders with the numerals of the cylinders set to #N (#1 to #4). In this case, as shown in Table 1, a disconnection in the main signal line L21 of the energy supply signal IGW (IGW signal disconnection) and an abnormality in the energy supply circuit 4 monitored by the circuit abnormality determination section 53 (IGW circuit abnormality) can be separately detected for each cylinder.

The engine ECU 100 determines the need for the operation of, for example, an external notification system in accordance with the number of abnormalities and the number of disconnections counted by the IGW path abnormality determination process in FIG. 6 prior to, for example, the generation of the energy supply signal IGW in the IGW generating section 102. An exemplary process for generating the energy supply signal IGW performed for each cylinder (hereinafter, referred to as the IGW signal generation process) in this case will be described using the flowchart shown in FIG. 7.

Figure 7:
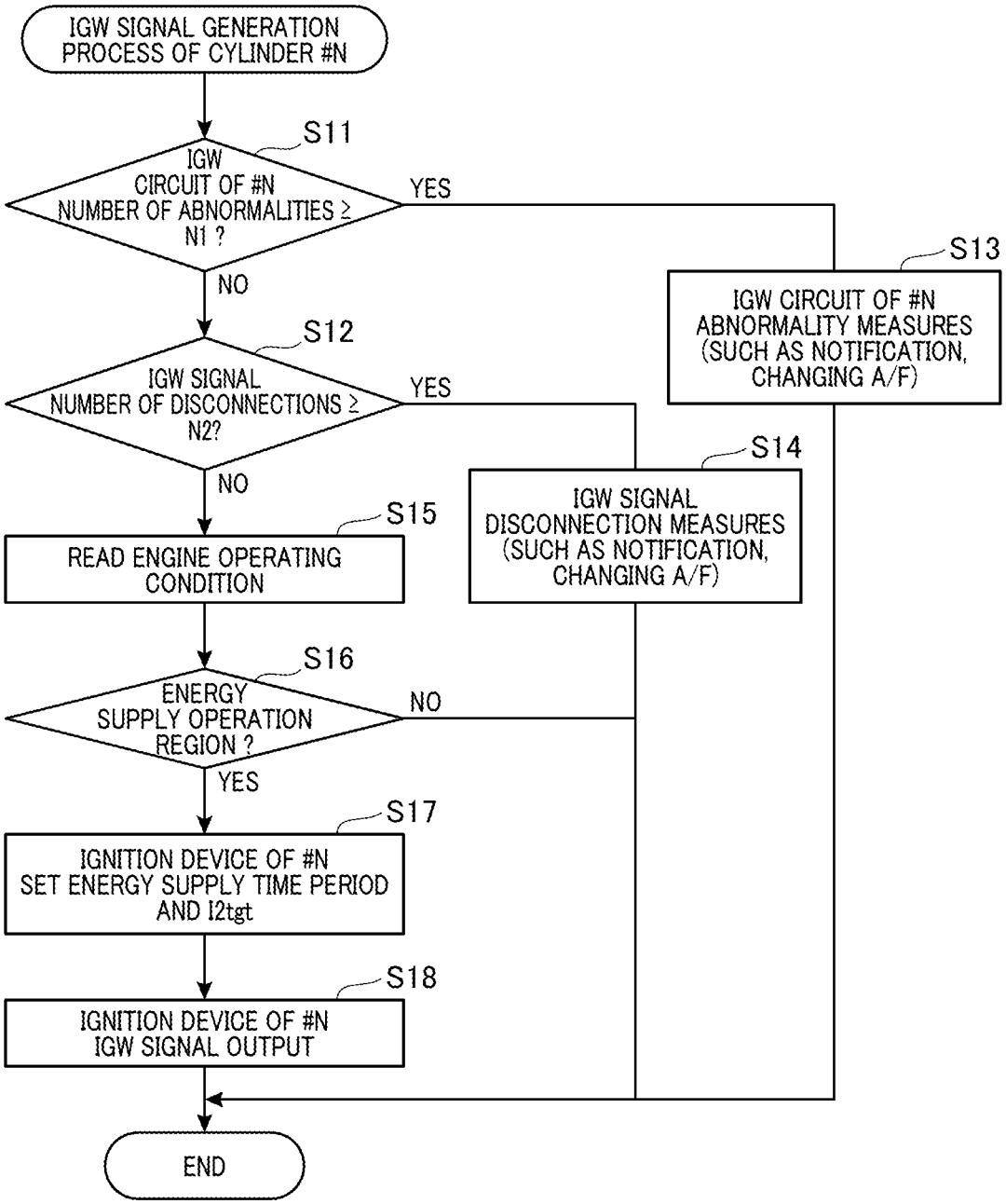
FIG. 7 is a control flowchart of an energy supply operation performed by the controller of the ignition control system according to the first embodiment.

In FIG. 7, when the IGW signal generation process is started for the cylinder #N, first, at step S11, it is determined whether the number of abnormalities of the cylinder #N detected by the IGW monitor 103 is greater than or equal to a predetermined number of times N1 (that is, IGW circuit of #N, number of abnormalities≥N1?). If the decision outcome of step S11 is negative, the process proceeds to step S12, and it is determined whether the number of disconnections detected by the IGW monitor 103 is greater than or equal to a predetermined number of times N2 (that is, IGW signal of #N, number of disconnections≥N2?).

Steps S11 and S12 are for avoiding erroneous detection of a circuit abnormality or a disconnection, and the predetermined number of times N1 and N2 can be set to a certain number of times (for example, the predetermined number of times N1=10, and the predetermined number of times N2=10).

If the decision outcome of step S11 is positive, the process proceeds to step S13. At step S13, as the measures taken when an abnormality occurs in the energy supply circuit 4 of the ignition device 10, for example, an occupant may be notified of the occurrence of the abnormality by turning on a warning light using the notification system of the vehicle. Alternatively, the air-fuel ratio (A/F) set in the fuel injection system of the engine may be changed to be richer to avoid the deterioration of the ignitability when the energy supply operation is not performed. Subsequently, this iteration of the routine is terminated.

If the decision outcome of step S12 is positive, the process proceeds to step S14. At step S14, for example, an occupant may be notified using the notification system of the vehicle, or the air-fuel ratio may be changed to ensure the ignitability like in step S13 as the measures taken when a disconnection occurs. The routine is then temporarily suspended.

If the decision outcome of step S12 is negative, the process proceeds to step S15, and the current engine operating condition is read. Subsequently, at step S16, it is determined whether the engine is in the previously set energy supply operation region in accordance with the engine operating conditions such as the engine rotational speed and the load. If the decision outcome of step S16 is negative, this iteration of the routine is terminated.

If the decision outcome of step S16 is positive, the process proceeds to step S17, and the energy supply time period and the target secondary current value I2tgt when the energy supply operation is performed are set for the ignition device 10 of the cylinder #N. The engine ECU 100 can have the map of the energy supply time period and the target secondary current value I2tgt corresponding to the engine operating region previously stored therein.

Subsequently, the process proceeds to step S17, and the energy supply signal IGW is output in accordance with the energy supply time period and the target secondary current value I2tgt set at step S16. As described above, the target secondary current value I2tgt is indicated by the rising phase difference (for example, the rise time difference Ta) between the main ignition signal IGT and the energy supply signal IGW and indicates the end of the energy supply time period by the falling of the energy supply signal IGW. Thus, a pulsed energy supply signal IGW is generated at an appropriate point in time in accordance with the set values of the energy supply time period and the target secondary current value I2tgt and is transmitted to the main signal line L21.

The routine is then temporarily suspended.

According to the configuration of the present embodiment, the IGW signal line L2 located between the engine ECU 100 and the ignition devices 10 is constituted by the common main signal line L21 and the bifurcated portions 5*a* to 5*d*, which sequentially bifurcate inside the ignition devices 10. Thus, the branched portions are not formed in the middle of the wiring connecting between the devices, and the reliability of the wiring is improved. Since the branched portions do not concentrate, an increase in the size of the branched portions or an increase in the rigidity does not occur, which increases the degree of freedom in mounting the wiring.

Since the main signal line L21 sequentially passes through the ignition devices 10 and returns to the engine ECU 100 from the main line L211 of the last bifurcated portion 5*d*, a disconnection in the main signal line L21 is detected by monitoring the signal of the signal path by the IGW monitor 103. Furthermore, inside each ignition device 10, the branched line L22 of the associated one of the bifurcated portions 5*a* to 5*d* is connected to the energy supply circuit 4, and the main line L211 is connected to the signal level holding section 55, which is operated when an abnormality occurs in the energy supply circuit 4. Thus, the IGW monitor 103 detects an abnormality in the energy supply circuit 4.

The IGW monitor 103 can be operated not only when the energy supply operation is performed but also in a region other than the energy supply region. For example, the main ignition signal IGT and the energy supply signal IGW may be sequentially output to the ignition devices 10 of the cylinders before starting the engine after the power supply is switched on or after the engine is stopped to detect an abnormality or a disconnection in the energy supply circuit 4.

This increases the detection frequency of the IGW monitor 103, enables detecting a circuit abnormality and a disconnection before the energy supply operation, and improves the reliability of the ignition control system 1. The main ignition signal IGT and the energy supply signal IGW in this case are preferably output at a minimum time period necessary for checking with an energy that does not influence the engine combustion.

Second Embodiment

Figure 8:
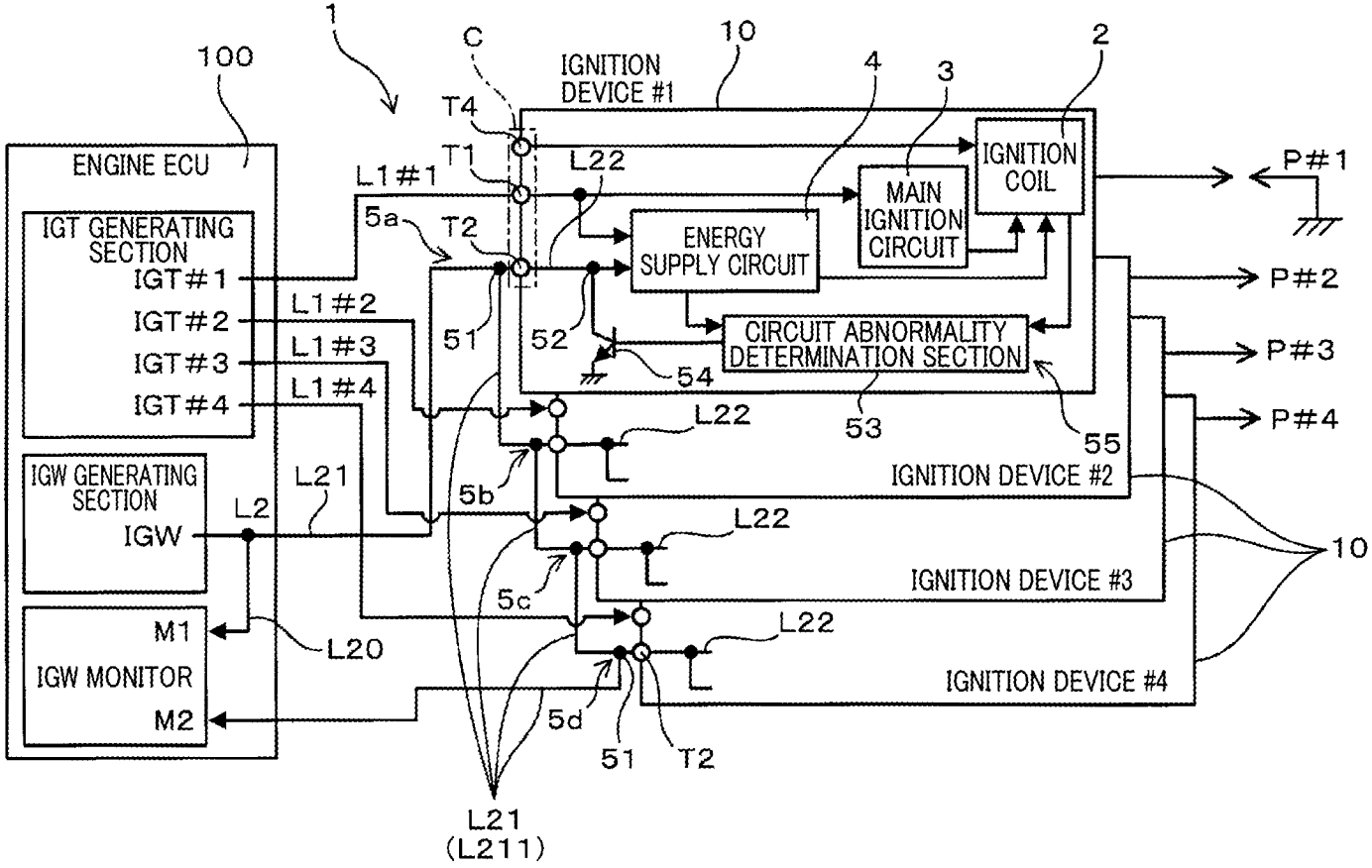
FIG. 8 is a schematic diagram illustrating the entire configuration of an ignition control system for an internal combustion engine according to a second embodiment.

An ignition control system for an internal combustion engine according to a second embodiment will be described with reference to FIGS. 8 and 9.

In the first embodiment, the bifurcated portions 5*a* to 5*d* of the IGW signal line L2 are located inside the ignition devices 10. In the present embodiment, however, the bifurcated portions 5*a* to 5*d* corresponding to the ignition devices 10 are located outside of the connector sections C of the ignition devices 10, and the IGW output terminals T3 are omitted as shown in FIG. 8. Other basic structures of the ignition devices 10 and the engine ECU 100 are the same as those of the first embodiment, and the differences from the first embodiment will mainly be described below.

The reference numerals used in and after the second embodiment that are the same as the reference numerals in the previously described embodiment refer to the same components as those in the previously described embodiment unless otherwise specified.

In the present embodiment, the structure of the connector section C of each ignition device 10 is the same as that in the first embodiment, and the four IGT signal lines L1 (L1 #1 to L1 #4) provided for the cylinders are each connected to the IGT input terminal T1 of the associated connector section C. The IGW signal line L2 includes the main signal line L21 common to the four ignition devices 10 and the four bifurcated portions 5*a* to 5*d* corresponding to the four ignition devices 10. The common main signal line L21 includes one end connected to the IGW generating section 102 and the other end that bifurcates one after the other from the main signal line L21 to form the bifurcated portions 5*a* to 5*d*.

First, the bifurcated portion 5*a* corresponding to one of the four ignition devices 10 (for example, the ignition device #1 corresponding to the cylinder #1) branches from the main signal line L21. The branch point 51 of the bifurcated portion 5*a* is located close to the outside of the connector section C, and the branched line L22, which branches from the branch point 51 is connected to the IGW input terminal T2 and is connected to the energy supply circuit 4 inside the ignition device 10. The other line connected to the branch point 51 of the bifurcated portion 5*a* is the main line L211, which constitute part of the main signal line L21 and forms a pair with the branched line L22. The main line L211 is connected to another ignition device 10 (for example, the ignition device #2 corresponding to the cylinder #2) as it is. In the ignition device 10 of the cylinder #1, the basic structure of the signal level holding section 55 is the same as that of the first embodiment, and the switching element 54 is connected to the contact point 52 provided on the branched line L22, which is connected to the IGW input terminal T2.

The bifurcated portion 5*b* subsequently branches from the main signal line L21, which serves as the main line L211 of the bifurcated portion 5*a*, and the branched line L22 of the bifurcated portion 5*b* is connected to the energy supply circuit 4 inside the ignition device 10 of the cylinder #2. The bifurcated portion 5*c* and the bifurcated portion 5*d* further sequentially branch from the main line L211 of the bifurcated portion 5*b*. The branched line L22 of the bifurcated portion 5*c* is connected to the energy supply circuit 4 in the ignition device 10 of the cylinder #3, and the branched line L22 of the bifurcated portion 5*d* is connected to the energy supply circuit 4 in the ignition device 10 of the cylinder #4. The bifurcated portion 5*d* that branches last includes the main line L211 connected to the branch point 51. The main line L211 serves as the distal end of the main signal line L21 as it is and is connected to the IGW monitor 103 of the engine ECU 100.

With the bifurcated portions 5*a* to 5*d* configured as described above also, the engine ECU 100 and the four ignition devices 10 are connected by one continuous main signal line L21. One end of the main signal line L21 is connected to the first monitor terminal M1 of the IGW monitor 103 through the signal line L20, and the distal end of the main signal line L21 is connected to the second monitor terminal M2. Thus, a circuit abnormality and a disconnection can be detected in the same manner.

The branching position of the bifurcated portion 5*a* is preferably at, for example, a position closer to the ignition device 10 than half the entire length of the main signal line L21 between the engine ECU 100 and the connector section C of the ignition device 10 of the cylinder #1. Furthermore, similarly, the branching position of each of the bifurcated portions 5*b* to 5*d* located between the ignition devices 10 is preferably at a position closer to the output end than half the entire length of the main signal line L21 from which each of the bifurcated portions 5*b* to 5*d* branches.

This further reduces the length of the main line L211, which extends from the branch point 51 to the next ignition device 10, so that the bifurcated portions 5*a* to 5*d* are reduced in size, and the degree of freedom in mounting the signal line is improved. Additionally, since the length of the path is reduced, the influence of the electrical noise radiation from the inside of the ignition devices 10 and the external noise is reduced. Each of the bifurcated portions 5*a* to 5*d* is preferably located at the connecting terminal portion C1, which is connected to the connector section C of each ignition device 10 (for example, refer to FIG. 4), or on the connection end of the main signal line L21 close to the connecting terminal portion C1.

Figure 9:
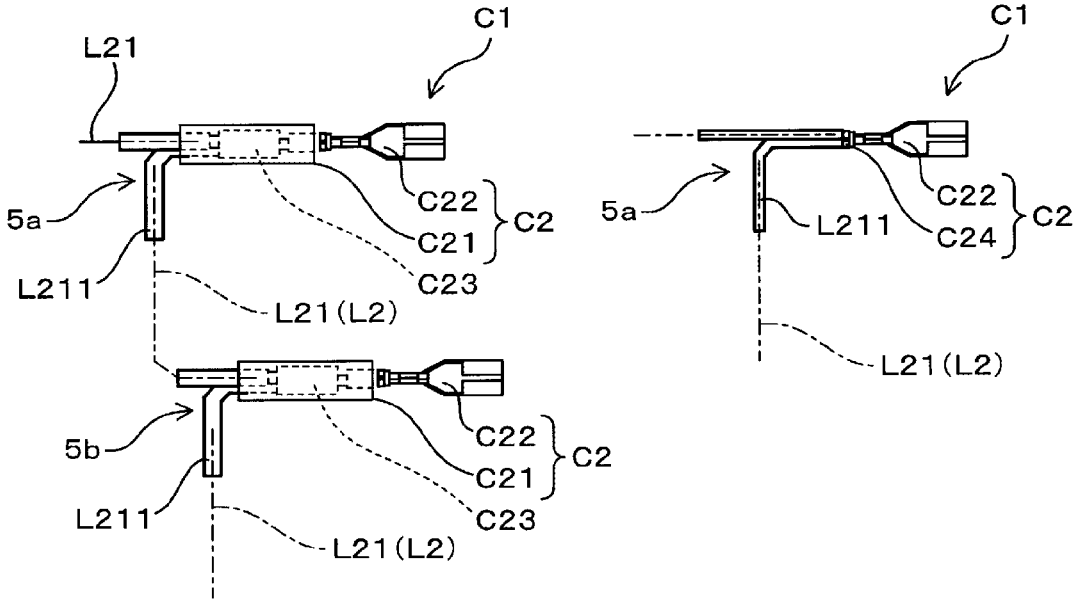
FIG. 9 is a schematic diagram illustrating a connecting terminal of an IGW signal line showing an exemplary configuration of the connection end between the IGW signal line and the ignition device according to the second embodiment.

FIG. 9 is an exemplary configuration of a case in which each of the bifurcated portions 5*a* to 5*d* is provided at the connecting terminal portion C1 and shows the main part of a connecting terminal C2 of the IGW signal line L2 in the connecting terminal portion C1. For example, as shown on the left side in FIG. 9, the connecting terminal C2 of the IGW signal line L2 includes a holder C21 and a terminal portion C22. The holder C21 holds the main signal line L21, which extends from the engine ECU 100, together with the signal line that serves as the main line L211 of the bifurcated portion 5*a*. The terminal portion C22 is connected to the IGW input terminal T2 of the connector section C. The holder C21 and the terminal portion C22 are integrated. Two signal lines including the main signal line L21 and the main line L211 of the bifurcated portion 5*a* are arranged side by side in the tubular holder C21 with the insulation film removed and are crimped inside a crimp portion C23.

The bifurcated portion 5*b*, which branches from the main line L211 of the bifurcated portion 5*a*, has the same structure. The main line L211, which extends from the rear end of the holder C21 (that is, the end further from the terminal portion C22), is connected to the rear end of the connecting terminal C2 at which the bifurcated portion 5*b* is formed.

As shown on the right side in FIG. 9, the connecting terminal C2 does not necessarily have to be provided with the holder C21. Two signal lines including the main signal line L21 and the main line L211 of the bifurcated portion 5*a* may be integrally crimped at a crimp portion C24 with the insulation film being removed from the crimped portion.

With the configuration according to the present embodiment also, since the IGW signal line L2, which is located between the engine ECU 100 and the ignition devices 10, is constituted by the common main signal line L21 and the bifurcated portions 5*a* to 5*d*, which are sequentially bifurcated outside the ignition devices 10, the compact, highly reliable ignition control system that achieves the same advantages as the first embodiment is provided.

In each of the above embodiments, the main signal line L21 drawn out from the last bifurcated portion 5*d* among the bifurcated portions 5*a* to 5*d* of the IGW signal line L2 returns to the IGW monitor 103 of the engine ECU 100. However, a different structure may be employed. For example, an abnormality diagnosis device for a vehicle inspection may be provided outside instead of the IGW monitor 103. The main signal line L21 that is drawn out from the last bifurcated portion 5*d* may be connected to the abnormality diagnosis device to perform an abnormality diagnosis.

The IGW monitor 103 is provided with the first monitor terminal M1 and the second monitor terminal M2 and receives the signals from both ends of the main signal line L21 for comparing the signals. However, the signals may be separately monitored, or only one of the signals need to be monitored. More preferably, only the second monitor terminal M2 needs to be monitored.

Third Embodiment

Figure 10:
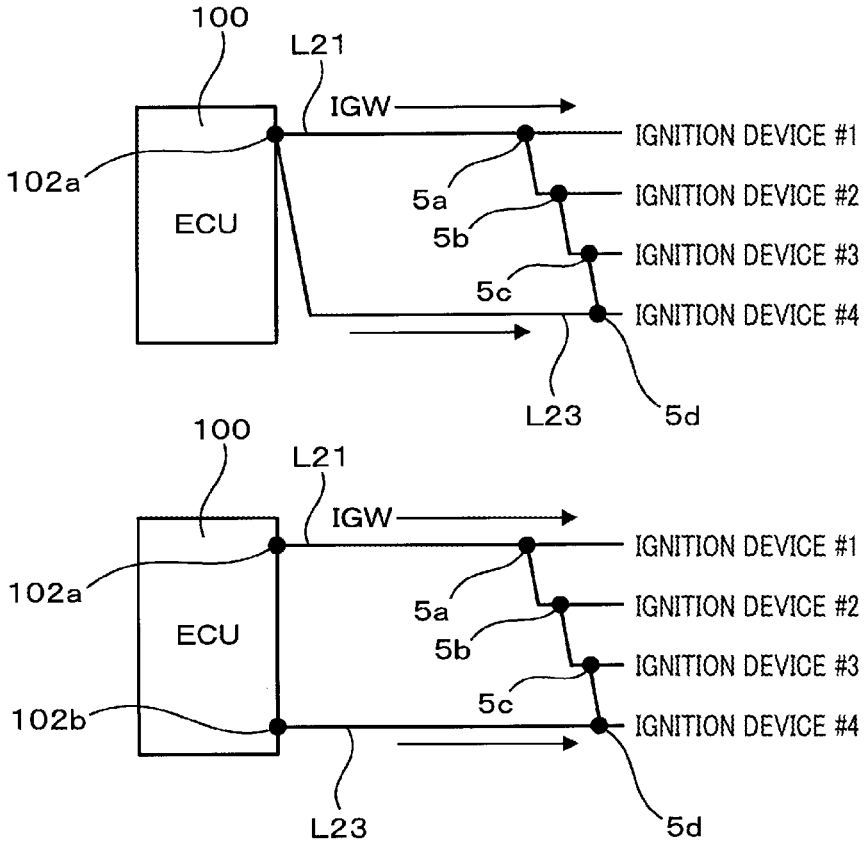
FIG. 10 is a schematic diagram illustrating an exemplary connection structure of a signal line between a controller of an ignition control system and an ignition device according to a third embodiment.

An ignition control system for an internal combustion engine according to a third embodiment will be described with reference to FIG. 10.

In each of the above embodiments, the last bifurcated portion 5*d* among the bifurcated portions 5*a* to 5*d* of the IGW signal line L2 returns to the IGW monitor 103.

However, the ignition control system 1 does not necessarily have to include the second monitor terminal M2 of the IGW monitor 103.

In this case, the wiring to the IGW output terminal T3 of the last bifurcated portion 5*d* may be omitted, and the IGW output terminal T3 may be covered with a dummy plug, for example. This simplifies the circuit and reduces the costs.

Alternatively, the IGW output terminal T3 of the connector section C to which the last bifurcated portion 5*d* is connected may be the second IGW input terminal T2, and the last bifurcated portion 5*d* may be connected to the IGW generating section 102 through a sub-signal line L23. In this case, for example, as shown on the upper side in FIG. 10, the sub-signal line L23 may branch from the main signal line L21 at an output terminal 102*a* of the IGW generating section 102. The main signal line L21 may be connected to the ignition device 10 of the cylinder #1, and the sub-signal line L23 may be connected to the ignition device 10 of the cylinder #4. Alternatively, as shown on the lower side in FIG. 10, one end of the main signal line L21 may be connected to the output terminal 102*a* of the IGW generating section 102, and one end of the sub-signal line L23 may be connected to an output terminal 102*b* of the IGW generating section 102. The other end of the main signal line L21 may be connected to the ignition device 10 of the cylinder #1, and the other end of the sub-signal line L23 may be connected to the ignition device 10 of the cylinder #4. The structure in which the bifurcated portions 5*a* to 5*d* of the IGW signal line L2 are provided corresponding to the ignition devices 10 is the same as each of the above-described embodiments.

With the configuration in which the energy supply signal IGW is input from both ends of the IGW signal line L2 as described above, even if, for example, a disconnection occurs anywhere in the main signal line L21 including the bifurcated portions 5*a* to 5*d*, the energy supply operation can be performed using the energy supply signal IGW input from either the main signal line L21 connected to the bifurcated portion 5*a* or the sub-signal line L23 connected to the bifurcated portion 5*d*.

With the configuration according to the present embodiment also, since the IGW signal line L2, which is located between the engine ECU 100 and the ignition devices 10, is constituted by the common main signal line L21 and the bifurcated portions 5*a* to 5*d*, which are sequentially bifurcated inside the ignition devices 10, the compact, highly reliable ignition control system that achieves the same advantages as the first embodiment is provided.

The present disclosure is not limited to the above embodiments, and various modifications are possible without departing from the scope of the disclosure. For example, the main ignition signal IGT and the energy supply signal IGW are described in accordance with the case of the positive logic signal in which the signal voltage at the H level represents logic 1. However, the negative logic signal in which the potential is reversed may be employed.

The configuration of the ignition coil 2 and the energy supply circuit 4 may be modified as required. For example, in the configuration of the first embodiment, two sets of ignition coils 2 each including the primary coil 21 and the secondary coil 22 may be provided as disclosed in International Publication 2017/010310. In this case, the two sets of ignition coils 2 are connected in series as the main ignition coil and the sub-ignition coil. While the main ignition operation of the main ignition coil is performed by the main ignition circuit 3, the energy supply operation of the sub-ignition coil is performed by the energy supply circuit 4 to superimpose the generated energy on the main ignition coil with the same polarity.

Alternatively, one set of ignition coil 2 including the primary coil and the secondary coil may be provided. While the main ignition operation is performed by the main ignition circuit 3, the energy supply operation is performed using the energy supply circuit 4 including a boost circuit and a capacitor, so that the energy stored in the capacitor by the boost circuit is input from the low potential side of the primary coil 21, and thus superimposing current having the same polarity.

As described above, the energy supply circuit 4 for performing the energy supply operation to the ignition coil 2 is not limited to the configuration shown in the first embodiment, but may have any configuration as long as the energy supply operation is performed after the main ignition operation, so that the secondary current I2 having the same polarity is superimposed.

The internal combustion engine does not necessarily have to be a gasoline engine for automobiles, but may be various spark ignition internal combustion engines. The configuration of the ignition coil 2 and the ignition devices 10 may be changed as required in accordance with the internal combustion engine on which the ignition coils 2 and the ignition devices 10 are mounted.

In the above-described embodiments, the IGW signal line is branched and connected to the ignition devices 10 with the bifurcated portions provided for the ignition devices 10 of all the cylinders. However, the IGW signal line only needs to be bifurcated to connect to two or more ignition devices 10 and does not necessarily have to connect to all the cylinders.

What is claimed is:

1. An ignition control system for an internal combustion engine comprising:

a plurality of ignition devices corresponding to a plurality of cylinders of the internal combustion engine, and a controller, which outputs signals for controlling the ignition devices, wherein each ignition device includes:

an ignition coil, which generates discharge energy in a secondary coil connected to an ignition plug by an increase and decrease in a primary current that flows through a primary coil, a main ignition circuit, which controls current supply to the primary coil to perform a main ignition operation that causes a spark discharge at the ignition plug, and an energy supply circuit, which performs an energy supply operation that superimposes current on a secondary current that flows through the secondary coil by the main ignition operation, the controller includes:

an IGT generating section, which generates a main ignition signal for controlling the main ignition operation, and an IGW generating section, which generates an energy supply signal for controlling the energy supply operation, wherein the controller is connected to the ignition devices through an IGT signal line for transmitting the main ignition signal and an IGW signal line for transmitting the energy supply signal, the IGW signal line includes a common main signal line having one end connected to the controller and a plurality of bifurcated portions, which sequentially bifurcate from the main signal line, wherein the bifurcated portions each correspond to one of the ignition devices and include a branched line, which is connected to the energy supply circuit inside the corresponding ignition device, the bifurcated portions each include a main line, which forms a pair with the branched line, and the main lines are connected in series with each other and form a part of the main signal line, the controller includes an IGW monitor, which is connected to a signal path of the IGW signal line and monitors the energy supply signal, and the IGW monitor receives a signal from the main line of the bifurcated portion that branches last from the main signal line, which serves as a distal end of the signal path of the IGW signal line, and the IGW monitor compares the signal input from the distal end with the energy supply signal output to one end of the main signal line from the IGW generating section to determine whether there is an abnormality.

2. The ignition control system for the internal combustion engine according to claim 1, wherein the bifurcated portions are each located inside the corresponding ignition device or on an end connected to the corresponding ignition device.

3. The ignition control system for the internal combustion engine according to claim 2, wherein each ignition device includes a connector section, which includes an IGT input terminal, to which the IGT signal line is connected, and an IGW input terminal and an IGW output terminal, to which the main signal line is connected, and the bifurcated portions are each located between the IGW input terminal and the energy supply circuit in the associated ignition device, and the main line is connected to the IGW output terminal.

4. The ignition control system for the internal combustion engine according to claim 2, wherein each ignition device includes a connector section, which includes an IGT input terminal, to which the IGT signal line is connected, and an IGW input terminal and an IGW output terminal, to which the main signal line is connected, and the bifurcated portions are each located at the connecting terminal portion of the main signal line, which is connected to the connector section.

5. The ignition control system for the internal combustion engine according to claim 3, wherein each ignition device includes a signal level holding section, which holds a level of a signal of the main signal line to an off state when an abnormality is detected in the energy supply circuit.

6. The ignition control system for the internal combustion engine according to claim 2, wherein the IGW signal line includes a sub-signal line, which connects the main line of the bifurcated portion that branches last from the main signal line to the IGW generating section and transmits the energy supply signal from the IGW generating section.

7. The ignition control system for the internal combustion engine according to claim 1, wherein the primary coil of the ignition coil includes a main primary coil and a sub-primary coil, and the energy supply circuit controls current supply to the sub-primary coil to control the energy supply operation.

* * * * *